United States Patent [19]

Godfrey et al.

[11] Patent Number: 4,511,111

[45] Date of Patent: Apr. 16, 1985

[54] PORTABLE KEYBOARD SUPPORT

[75] Inventors: Steven W. Godfrey, Florence, Ky.; Allen M. Stern, Havertown, Pa.; Fran W. MacGregor, New Britain, Conn.

[73] Assignee: Hunt Manufacturing Co., Philadelphia, Pa.

[21] Appl. No.: 465,668

[22] Filed: Feb. 10, 1983

[51] Int. Cl.[3] ..... A47G 29/10

[52] U.S. Cl. ..... 248/459; 248/346

[58] Field of Search ..... 248/346, 459, 456, 311.2, 248/639, 442.2; 108/28, 29, 59; D6/85, 181; D19/91, 92; 340/700, 365 R; 40/341, 904

[56] References Cited

U.S. PATENT DOCUMENTS

| | | | |
|---|---|---|---|
| D. 266,672 | 10/1982 | Landin . | |
| 1,052,046 | 2/1913 | Elliott | 248/442.2 |
| 1,807,517 | 5/1931 | Erlenson . | |
| 3,380,701 | 4/1968 | Byers | 248/459 |
| 3,830,352 | 8/1974 | Kolpeck . | |
| 3,902,034 | 8/1975 | Isozaki . | |
| 4,269,381 | 5/1981 | Harms | 248/222.2 |
| 4,305,563 | 12/1981 | Presson . | |
| 4,313,112 | 1/1982 | Foster . | |
| 4,318,471 | 3/1982 | Hutton | 248/459 |
| 4,326,193 | 4/1982 | Markley . | |
| 4,369,948 | 1/1983 | Krauss | 248/456 |

*Primary Examiner*—Reinaldo P. Machado
*Assistant Examiner*—Alvin Chin-Shue
*Attorney, Agent, or Firm*—John F. A. Earley; John F. A. Earley, III

[57] ABSTRACT

A portable keyboard support for use in combination with a table surface and a weight for supporting a keyboard has a first member adapted to overlie a table surface and support a weight for securing the first member to the table surface. A second member is located in front of and below the first member for supporting a keyboard and is connected by a third member to the first member. Advantageously, the second member slopes downwardly away from the third member and has a stop to prevent the keyboard from sliding off it. It is preferred to have the third member at right angles to the first member and adapted to abut against the front of the table.

3 Claims, 2 Drawing Figures

PORTABLE KEYBOARD SUPPORT

TECHNICAL FIELD

This invention is in the field of office furniture.

BACKGROUND OF THE PRIOR ART

It is well known in the prior art to use separate portable keyboards for the operation of computer-related equipment such as small portable computers, word processors and remote computer terminals. Such portable keyboards are normally used in close spatial association with one or more other devices such as cathode ray tube display screens, a desktop-size computer and/or a printer.

The portable keyboard, together with the devices closely associated therewith are normally placed together on a table, desk or credenza, all of which are included in the term "table" as used herein. With such conventional office furniture which is 29" high it is not possible to orient the keyboard with the associated equipment such as a display screen or printer directly in back of the keyboard with the front of the keyboard on a support which is about 26" to about 27" from the floor which is ideal for typing. This problem is solved by the portable keyboard support of the invention which additionally assures that the keyboard operator has plenty of leg room and places the keyboard on a desirable slant. The portable keyboard support of the invention is a fraction of the cost of custom-made furniture, the need for which is eliminated, and is quickly installed or removed without the use of any tools or fittings.

BRIEF SUMMARY OF THE INVENTION

A portable keyboard support for use in combination with a table surface and a weight for supporting a keyboard has a first member adapted to overlie a table surface and support a weight for securing the first member to the table surface. A second member is located in front of and below the first member for supporting a keyboard and is connected by a third member to the first member. Advantageously, the second member slopes downwardly away from the third member and has a stop to prevent the keyboard from sliding off it. It is preferred to have the third member at right angles to the first member and adapted to abut against the front of the table.

DETAILED DESCRIPTION

Figure 1:
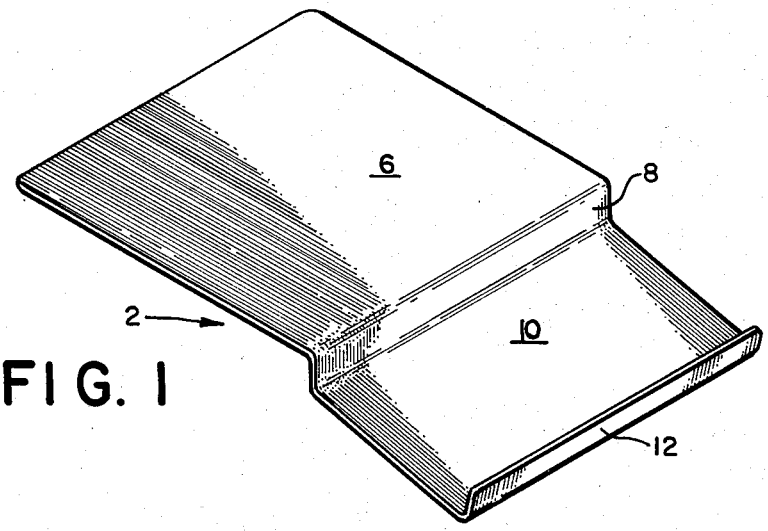
FIG. 1 is a front perspective view of a portable keyboard support in accordance with the invention and FIG. 2 is a front perspective view of the keyboard support of FIG. 1 secured to a table by a cathode ray tube display screen and supporting a keyboard.

Referring to FIG. 1, a portable keyboard support 2 has a flat rear member 6 connected by a connecting member 8 to a keyboard support member 10. The top of the rear of member 10 advantageously is from about 1" to about 2" below the top of the front of member 6 and in this embodiment is 1.5" below the top of the front of member 6. Connecting member 8 forms a 90° angle with rear member 6. The interior angle between connecting member 8 and keyboard support member 10 is 100° so that, when installed, keyboard support member 10 will extend downwardly from front to back at an angle of about 10° from the horizontal. Preferably the interior angle will vary by only about 2°± from 100°. The front of keyboard support member 10 is provided with an upstanding flange 12 which acts as a stop member to hold a keyboard from sliding off the support member 10. Advantageously, the length of the keyboard support member 10 from front to back is from about 9" to about 11" and is 10" as specifically illustrated in this embodiment. The dimensions preferably are selected so that the top of keyboard support member 10 just inside the flange 12 will be in the range of from about 26" to about 27" from the floor when rear member 6 is on a table 29" high. Preferably rear member 6 will have a length from front to back greater than the front to back length of keyboard support member 10, for example, 18".

The keyboard support 2 is advantageously made from a plastic material such as an acrylic or an alkyd resin. The commercially available "PLEXIGLAS" of Rohm and Haas of Philadelphia, PA has been found to be very satisfactory. Of course, many other materials may be used, such as metals, for example, steel or aluminum, and wood.

Figure 2:
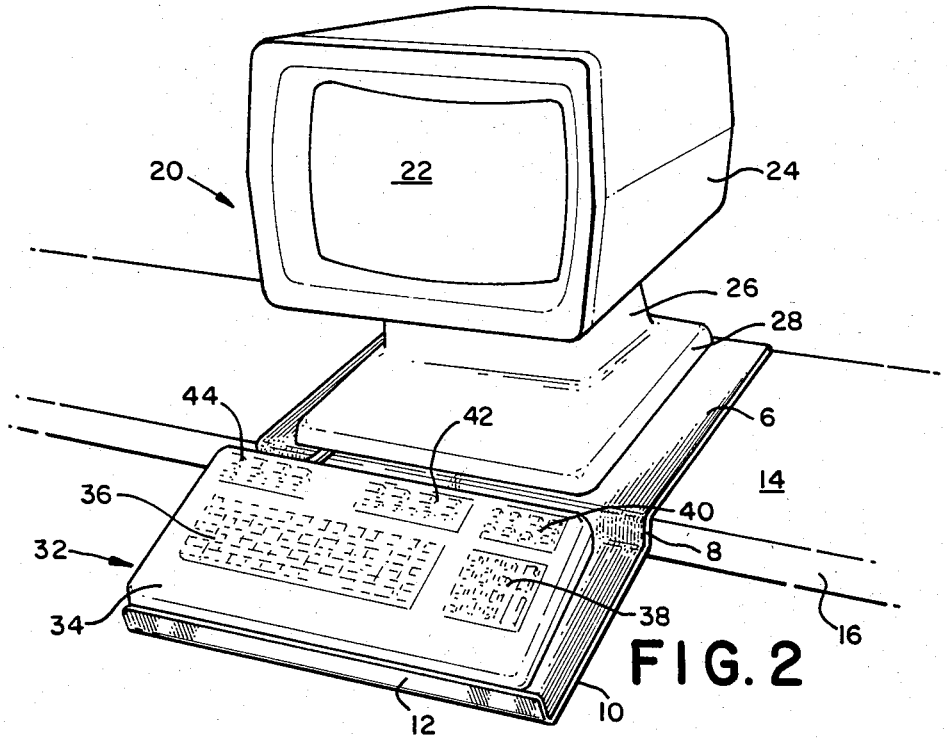

The keyboard support 2 is shown in use in association with a table 14 in FIG. 2. The rear member 6 is placed on the top of table 14, the connecting member 8 abutting against the front 16 of the table. Member 6 is held in place by a display device 20 having a cathode ray tube 22 in a housing 24 mounted on a pedestal 26 having a base 28 which rests on member 6 and acts as a weight to hold it down on table 14.

A conventional keyboard 32 has a casing 34 in which are mounted five separate sections of keys, 36, 38, 40, 42 and 44. The circuitry for word processing and computing is contained in casing 34. The keyboard 32 rests against the inner side of flange 12. The weight of the display device 20 is relatively large compared to the weight of the keyboard 32 and hence the keyboard support remains well secured to table 14 when the keyboard is being operated. The abutment of connecting member 8 against front 16 of table 14 gives the structure additional stability against being upset by any downward force exerted on the keyboard support member 10. It will, of course, be obvious that devices other than the display device 20, such as a printer, are suitable weights to securely hold the rear member 6 to the top of table 14.

It will be understood that the above described embodiment is illustrative and is not intended to be limiting.

We claim:

1. An integral portable keyboard support for use with a table and a weight such as a display screen, computer or printer for supporting a keyboard comprising:

a single sheet of material with, means for holding the keyboard support in place including a first flat rear laterally extending planar member adapted to lie on a table surface and support a weight for holding the first member to the table surface, said first member having a front edge and a rear edge, means for supporting a keyboard including a second flat laterally extending planar member in front of and below the first member, said second member having a front edge and a rear edge, said second member sloping downwardly from the rear thereof to the front thereof for supporting a keyboard, a third laterally extending planar member connecting the first and second members and adapted to abut against the front end of the table, said third member depending downwardly from the front edge of the first member to the rear edge of the second member, and an upstanding flange at the front edge of the second member acting as a stop to hold a keyboard on the second member, whereby the keyboard support may be placed on a table with its first flat member positioned flat against the table top and a display placed on top of the first flat member to anchor the keyboard support in place, the third member may be placed to abut the edge of the table, and a keyboard may be placed on the sloped second member and supported thereby.

2. A portable keyboard support in accordance with claim 1 in which the third connecting member is at right angles to the first member and depends downwardly therefrom.

3. A portable keyboard support for use with a table with a weight for supporting a keyboard comprising:

a single sheet of material with, a first rear laterally extending planar member adapted to overlie a table surface and support a weight for holding the first member to the table surface, said first member having a front edge, a rear edge, a top, and a bottom, a second front laterally extending planar member in front of and below the first member for supporting a keyboard, said second member having a front edge, a rear edge, a top and a bottom, said second member sloping downwardly from the rear thereof to the front thereof, an upstanding flange at the front edge of the second member to limit the movement of a keyboard mounted on the second member, and a third laterally extending planar member lying at 90° to the first member and connecting the first and second members, the top of the second member at its rear edge being from about 1" to about 2" below the top of the first member at its front edge and lying at an angle of about 100° to the third member, said keyboard support being made of a single sheet of acrylic or alkyd resin.

* * * * *